US011933030B2

(12) United States Patent
Kwon

(10) Patent No.: US 11,933,030 B2
(45) Date of Patent: Mar. 19, 2024

(54) FLUID FLOW CONTROL DEVICE FOR FAUCET PIECE

(71) Applicant: Rüscho-Schotenröhr GmbH, Castrop-Rauxel (DE)

(72) Inventor: Bok Min Kwon, Daegu (KR)

(73) Assignee: RÜSCHO-SCHOTENRÖHR GMBH, Castrop-Rauxel (DE)

( * ) Notice: Subject to any disclaimer, the term of this patent is extended or adjusted under 35 U.S.C. 154(b) by 186 days.

(21) Appl. No.: 17/739,422

(22) Filed: May 9, 2022

(65) Prior Publication Data

US 2022/0259842 A1 Aug. 18, 2022

Related U.S. Application Data

(63) Continuation of application No. PCT/KR2019/017263, filed on Dec. 9, 2019.

(30) Foreign Application Priority Data

Nov. 28, 2019 (KR) ..... 10-2019-0155991
Nov. 28, 2019 (KR) ..... 10-2019-0156020

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01); *Y10T 137/9464* (2015.04)

(58) Field of Classification Search
CPC ..... E03C 1/086; E03C 1/084; Y10T 137/9464
USPC ..... 137/801
See application file for complete search history.

(56) References Cited

U.S. PATENT DOCUMENTS 4,530,467 A * 7/1985 Bueno ..... E03C 1/08 251/352
5,397,064 A * 3/1995 Heitzman ..... B05B 1/185 239/DIG. 12
5,518,181 A * 5/1996 Shames ..... B05B 1/1609 239/446
6,412,710 B1 * 7/2002 Lin ..... B05B 1/185 239/548
7,314,062 B2 * 1/2008 Chen ..... E03C 1/0404 137/801
7,322,535 B2 * 1/2008 Erdely ..... B05B 1/1654 239/428

(Continued)

FOREIGN PATENT DOCUMENTS

JP H1025779 A 1/1998
JP 2011033133 A 2/2011

(Continued)

OTHER PUBLICATIONS

International Search Report of PCT/KR2019/017263 dated Aug. 13, 2020.

*Primary Examiner* — John Bastianelli
(74) *Attorney, Agent, or Firm* — NIXON PEABODY LLP; Jeffrey L. Costellia

(57) ABSTRACT

A fluid flow control device for a faucet piece with which anyone is able to easily control flow rate, flow velocity, hydraulic pressure, water stream size, and the like and includes a water dispersion means, a cylindrical type mounting member, a rotation guide means, and a control position stopper means.

11 Claims, 6 Drawing Sheets

(56) References Cited

U.S. PATENT DOCUMENTS

| | | | | |
|---|---|---|---|---|
| 7,909,062 | B2 * | 3/2011 | Chen | E03C 1/08 251/352 |
| 8,109,449 | B2 * | 2/2012 | Weis | F16K 3/085 239/581.1 |
| 8,689,830 | B2 * | 4/2014 | Chen | E03C 1/0412 251/208 |

FOREIGN PATENT DOCUMENTS

| | | | |
|---|---|---|---|
| KR | 200209234 | Y1 | 1/2001 |
| KR | 200462332 | Y1 | 9/2012 |
| KR | 101323466 | B1 | 10/2013 |
| KR | 101371780 | B1 | 3/2014 |
| KR | 101625095 | B1 | 5/2016 |

* cited by examiner (A)

(B)

FLUID FLOW CONTROL DEVICE FOR FAUCET PIECE

CROSS-REFERENCE TO RELATED APPLICATIONS

This application is a continuation of International Application No. PCT/KR2019/017263 filed on Dec. 9, 2019, which claims priority to Korean Patent Application No. 10-2019-0155991 filed on Nov. 28, 2019 and Korean Patent Application No. 10-2019-0156020 filed on Nov. 28, 2019, the entire contents of which are herein incorporated by reference.

TECHNICAL FIELD

The present disclosure relates to a fluid flow control device for a faucet piece and, more particularly, to a fluid flow control device for a faucet piece, which is an aerator that, besides having a basic function of gently discharging discharged water by being mounted in a spout of the faucet piece, enables anyone to easily control the flow rate (stepwise flow rate), flow velocity, hydraulic pressure, water stream size, and the like with, is easy to manufacture to improve productivity and to reduce manufacturing cost, and may be easily and robustly installed.

BACKGROUND ART

In general, when a water tap (that is, a faucet) is used in a public facility or home, a large amount of water is unconsciously drained, and thus water is wasted undesirably. To conserve water, the amount of water is controlled by adjusting a handle of the water tap each time.

However, it is very inconvenient for users to use water by adjusting the handle of the water tap at a fine angle, and it takes time and effort to adjust the water tap at a fine angle every time it is used. In addition, water is discharged and wasted while the handle of the water tap is adjusted, so it is difficult to actually save water.

As an example of a conventional device for controlling the amount of water discharged from a spout attached to an end of a faucet such as a water tap for washing face and the like, there is a Korean Utility Model Registration No. 20-209234 (Published on Jan. 16, 2001) described as a related art document below.

However, such a conventional device has a number of components and a complicated structure and has a disadvantage in that it is very inconvenient for users to control the amount of water discharged.

As a method to solve such a problem, Korean Utility Model Registration No. 20-0462332 (Published on Sep. 6, 2012) "Water-saving device of water supply" has been proposed.

However, the Korean Utility Model Registration No. 20-0462332 (Published on Sep. 6, 2012) aims to control the amount of water discharged, and although the water discharged by the nozzle and the distributor is discharged separately, jets of water discharged separately from each other are finally merged, thereby inducing a problem in that sizes of the streams of water are not constant to cause the water not to be discharged in a fine state (like shower type streams).

On the other hand, an aerator is a mechanism that softens the water flow when the water is discharged from a water tap, thereby functioning to allow the discharged water to be prevented from splashing in several directions and give the user a soft feeling when using the water. In addition, the aerator provides a function of saving water by preventing excessive water discharge per unit time. In fact, according to a study conducted in Germany, it was found that the water-saving effect is about 50% when one aerator is installed in the faucet.

In the case of using an economy-type aerator installed at a spout of a faucet, users have complained of great inconvenience in a situation where a lot of water is required. For this reason, the economy-type aerator has been reconstructed into a general aerator, thereby being turned into a useless device.

In addition, in the conventional method of setting by adjusting the main angle valve, in order to obtain the desired flow rate each time the user uses the water tap, the user has to bend his or her back to a lower space below a washbasin and reset the main angle valve, so it is inconvenient.

In this way, when using a faucet piece such as a water tap, it is necessary to use a water-saving device (water-saving adapter or fluid flow control device for a faucet piece) that may save water meaninglessly discharged away depending on individual habits and places of use and may conveniently set and fix the desired amount of water. Accordingly, research and development for the above-described device are required.

SUMMARY

Technical Problem

Accordingly, the present disclosure has been made keeping in mind the above problems occurring in the related art, and an objective of the present disclosure is to provide an aerator or a fluid flow control device for a faucet piece, which, besides having a basic function of gently discharging discharged water by being mounted in a spout of the faucet piece, enables anyone to easily control flow rate, flow velocity, hydraulic pressure, water stream size, and the like with, is easy to manufacture to improve productivity and to reduce manufacturing cost, and may be easily and robustly installed.

In addition, another objective of the present disclosure is to provide the fluid flow control device for a faucet piece, which may be easily and robustly installed, easily recognize a sense of stepwise control of flow rate, flow velocity, and hydraulic pressure, and stably maintain a control position to improve usability.

Issues to be solved of the present disclosure are not limited to those mentioned above, and other issues not mentioned will be clearly understood by those skilled in the art from the following description.

Technical Solution

In order to accomplish the above objective, the present disclosure may provide a fluid flow control device for a faucet piece, the device including: a cylindrical type housing provided with a plurality of water discharge holes at a bottom part and having an opening portion on an upper side; a water dispersion means provided inside the housing and configured to uniformly disperse water flowing in; a cylindrical type mounting member having a lower end portion coupled to be able to rotate to an upper end portion of the housing, provided with a plurality of water discharge holes at a bottom part, and fixed to a spout of the faucet piece; a screen mesh member provided at an upper end portion of the mounting member; a rotation guide means provided between the housing and the mounting member and configured to guide relative rotation of the housing and the mounting member; a fluid control means configured to control flow rate of water flowing into the housing due to relative rotation between the housing and the mounting member; and a control position stopper means configured to maintain a position of the cylindrical type housing rotated with respect to the cylindrical type mounting member.

Advantageous Effects

As described above, according to a fluid flow control device for a faucet piece according to the present disclosure, the following effects can be provided.

First, the present disclosure has the effect in that the device can be easily used by anyone to control a flow rate, flow velocity, hydraulic pressure, water stream size, and the like besides a basic function of gently discharging discharged water.

Second, the present disclosure has the effect in that each component constituting the device is easy to manufacture to promote productivity improvement and manufacturing cost reduction.

Third, the present disclosure has the effect in that each component constituting the device can be easily completely assembled.

Fourth, the present disclosure has the effect in that the device can be easily and robustly installed in the spout of the faucet piece.

Fifth, the present disclosure has the effect in that the device can easily recognize a sense of stepwise control of flow velocity and hydraulic pressure and can stably maintain a control position to improve usability.

The effects of the present disclosure are not limited to those mentioned above, and other effects not mentioned will be clearly understood by those skilled in the art from the following description.

DETAILED DESCRIPTION

Figure 1:
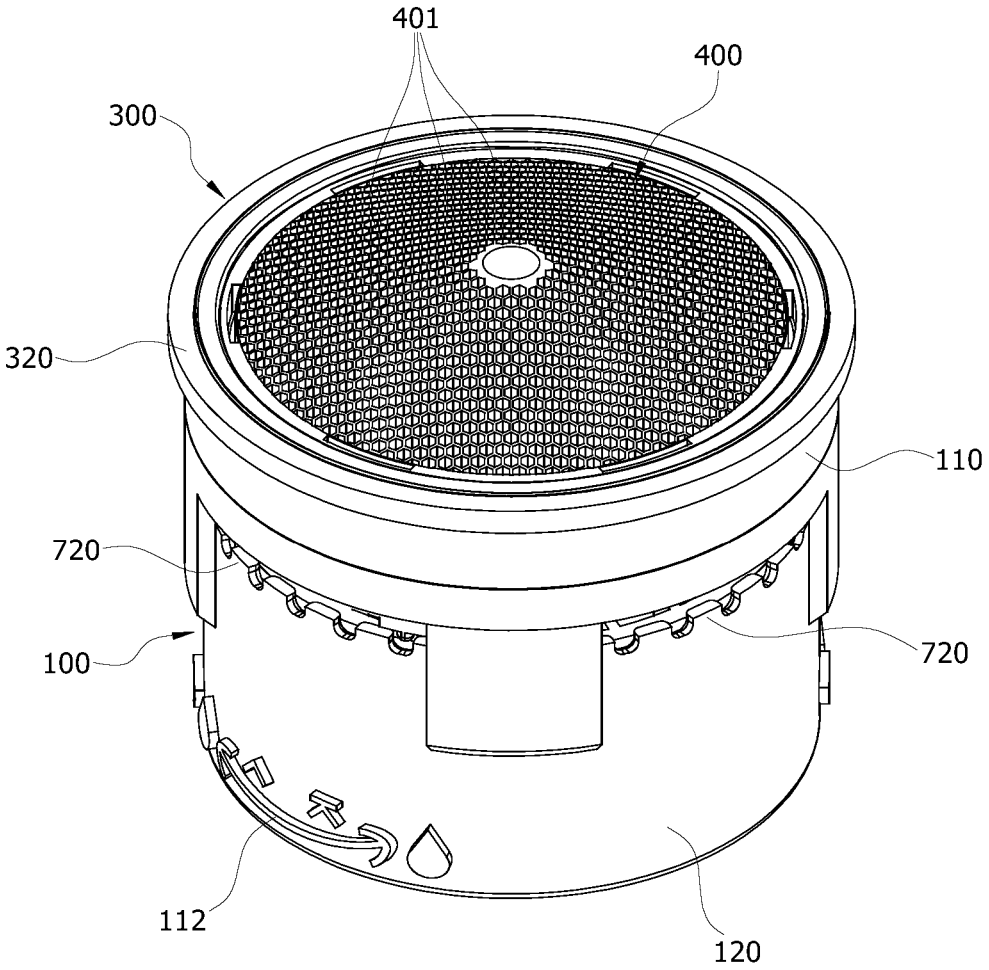
FIG. 1 is one side perspective view showing a fluid flow control device for a faucet piece according to the present disclosure.

According to one aspect of the present disclosure for achieving above objectives and other features of the present disclosure, there is provided a fluid flow control device for a faucet piece, the device including: a cylindrical type housing provided with a plurality of water discharge holes at a bottom part and having an opening portion on an upper side; a water dispersion means provided inside the housing and configured to uniformly disperse water flowing in; a cylindrical type mounting member having a lower end portion coupled to be able to rotate to an upper end portion of the housing, provided with a plurality of water discharge holes at a bottom part, and fixed to a spout of the faucet piece; a screen mesh member provided at an upper end portion of the mounting member; a rotation guide means provided between the housing and the mounting member and configured to guide relative rotation of the housing and the mounting member; a fluid control means configured to control flow rate of water flowing into the housing due to relative rotation between the housing and the mounting member; and a control position stopper means configured to maintain a position of the cylindrical type housing rotated with respect to the cylindrical type mounting member.

In the present disclosure, the fluid control means may include: a flow rate control plate member provided to be spaced apart from and interposed between the bottom part of the mounting member and the screen mesh member and having a plurality of flow rate control holes; and a flow rate control rotation blade member having one side positioned on an upper surface of the flow rate control plate member and an opposite side configured to pass through the mounting member and the water dispersion means and to be fixed to a fixing hole provided in a center of the housing.

In the present disclosure, the flow rate control plate member may include: a plate type body part; one or more flow rate control holes provided by penetrating through the plate type body part; an edge frame part provided to protrude toward a mounting member side; and one or more assembly protrusions or assembly grooves provided at the edge frame part and configured to be inserted into the assembly protrusions or assembly grooves provided in a bottom part of the mounting member, and the fluid control rotation blade member may include: a shaft having a predetermined length; and a plurality of blades provided at one end part of the shaft and positioned on upper surfaces of the flow rate control holes, respectively.

In the present disclosure, the flow rate control holes may be provided in a plurality of slots, each in an arc shape, with intervals therebetween at positions on a rotational orbit line that is spaced apart by a predetermined length in a radial direction from a center of the plate type body part, and the blades may be provided in a plurality of plate type blades in a fan shape extending outward from one end part of the shaft.

In the present disclosure, the water dispersion means may be provided with one or more plate type lattice network members each having a plurality of water passage holes and a shaft through-hole at a center, the screen mesh member is made of a plate-shaped screen mesh having a plurality of water passage holes, the mounting member may include: a cylindrical type body part provided with a plurality of water discharge holes at the bottom part and a shaft through-hole at a center; and a fixing flange portion provided to protrude outward in a radial direction on an outer periphery of an upper end of the body part, the housing may include: a large-diameter portion having a predetermined diameter; and a small-diameter portion having a smaller diameter than the large-diameter portion and provided with the water discharge holes in a bottom part, at a lower inner periphery of the large-diameter portion, a step portion is provided to protrude along a circumferential direction, and in a center of the bottom part of the small-diameter portion, a fixing hole or fixing groove, in which a lower end part of the fluid control rotation blade member constituting the fluid control means is fixedly mounted, is provided.

In the present disclosure, the water dispersion means may include: a first lattice network member having water passage holes; and a second lattice network member having water passage holes having a size and shape different from the water passage holes of the first lattice network member, wherein, on an outer periphery of one of the first lattice network member 210 and the second lattice network member 220, at least one of the assembly grooves and/or assembly protrusions may be provided, and on an outer periphery of another one of the first lattice network member 210 and the second lattice network member 220, at least one of the assembly grooves and/or assembly protrusions may be provided In the present disclosure, at one edge of the bottom part of the mounting member, an assembly protrusion or an assembly groove may be provided, and at an edge frame part of the flow rate control plate member, an assembly groove or an assembly protrusion, which is assembled with the assembly protrusion or the assembly groove of the mounting member, may be provided.

In the present disclosure, the screen mesh member may be provided to be inclined downward from a center to the edge, and at a center of the lower surface of the screen mesh member, a supporting protrusion, configured to come into contact with a center of an upper surface of the fluid control rotation blade member to support the screen mesh member, may be provided.

In the present disclosure, the rotation guide means may include a guide groove and a guide protrusion, each provided in the circumferential direction at corresponding one of parts facing each other between an upper end part of the housing and a lower end part of the mounting member, and the device may further include: a mounting groove provided in a circumferential direction on the outer periphery of the upper end of the mounting member; and an annular fixing member having a predetermined width and made of a flexible material, thereby being mounted and fixed to the mounting groove.

In the present disclosure, the control position stopper means may include: a slot provided in a predetermined length in the circumferential direction of the housing; a prominence and depression portion provided at a lower end of the slot; and a stopper protrusion provided at a position, corresponding to a position of the slot, on one side of a lower edge of the mounting member and separated from or settled in a depression portion of the prominence and depression portion due to the rotation of the housing.

MODE FOR INVENTION

Additional objectives, features, and advantages of the present disclosure may be more clearly understood from the following detailed description and accompanying drawings.

Prior to the detailed description of the present disclosure, the present disclosure is able to make various changes and have various embodiments, so examples described below and shown in the drawings are not intended to limit the present disclosure to specific embodiments and should be understood to include all modifications, equivalents, and substitutes included in the spirit and scope of the present disclosure.

When a component is referred to as being "connected" or "linked" to another component, it may be directly connected or linked to another component, but it should be understood that other components may exist in the middle. On the other hand, when a component is referred to as being "directly connected" or "directly linked" to another component, it should be understood that no other component is present in the middle.

Terms used herein are used only to describe specific embodiments, and are not intended to limit the present disclosure. The singular expression includes the plural expression unless the context is clearly expressed otherwise. In the present specification, terms such as "includes" or "have" are intended to designate that a feature, number, step, operation, component, part, or a combination thereof described in the specification exists but should be understood that this does not preclude the possibility of addition or existence of one or more other features, numbers, steps, operations, components, parts, or combinations thereof.

In addition, a term such as " . . . part", " . . . unit", " . . . module", or the like described in the specification means a unit that processes at least one function or operation and may be implemented with hardware, software, or a combination of hardware and software.

In addition, in the description with reference to the accompanying drawings, the same components are assigned to the same reference numerals regardless of the drawing numerals, and the overlapping description thereof will be omitted. In describing the present disclosure, when it is determined that a detailed description of related known technology may unnecessarily obfuscate the gist of the present disclosure, the detailed description thereof will be omitted.

In addition, throughout the present specification, when a certain step is located "on" or "before" another step, this includes the same rights not only in a case in which the certain step is in a direct time-series relationship with another step but also in a case in which the certain step is in an indirect time-series relationship with another step, wherein, in an indirect time-series relationship, an order of time-series of two steps, such as steps of being mixed with each other after each step is done, may be changed.

Hereinafter, a fluid flow control device for a faucet piece according to an exemplary of the present disclosure will be described in detail with reference to the accompanying drawings.

Figure 2:
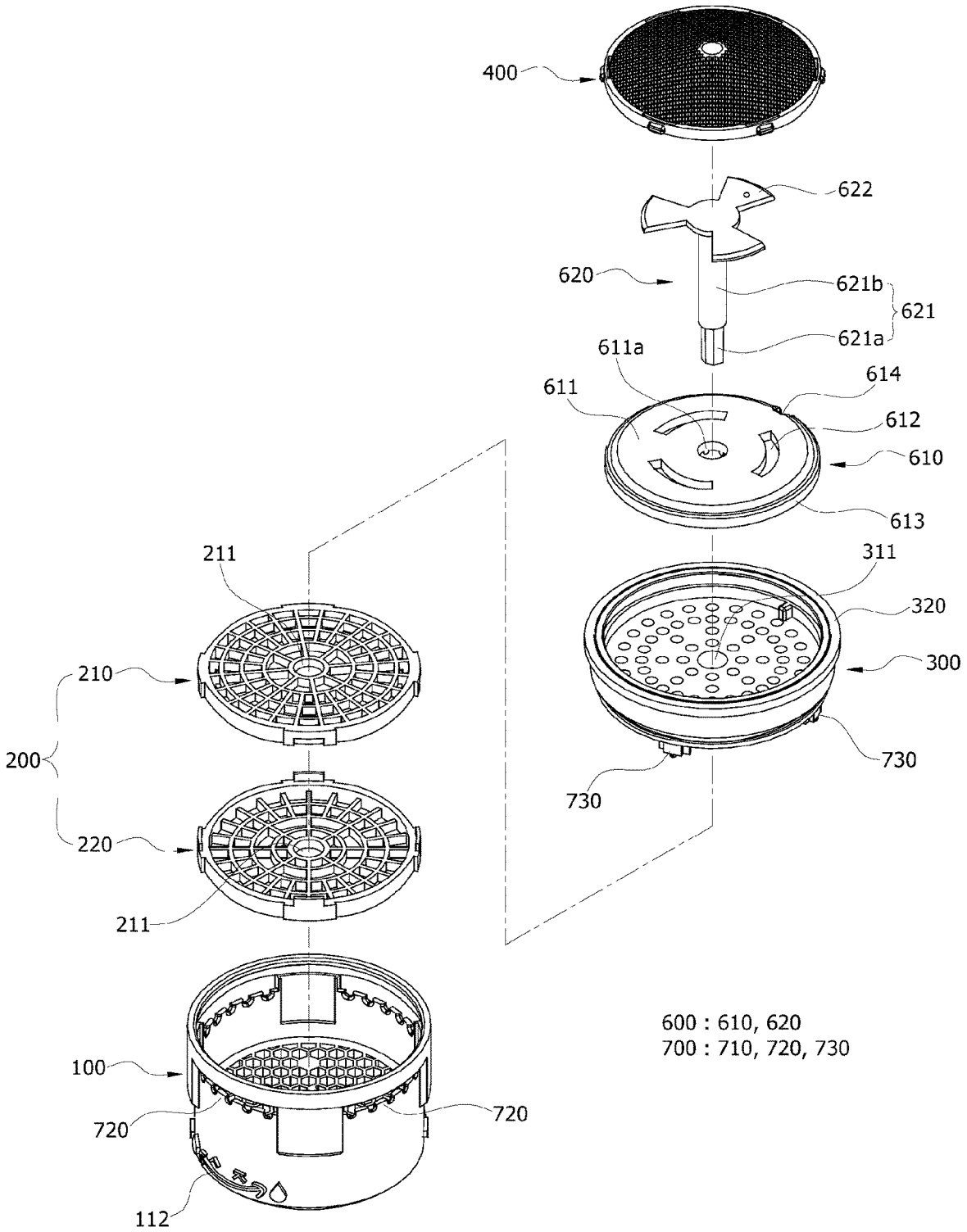
FIG. 2 is an exploded perspective view viewed from one side of the fluid flow control device for a faucet piece according to the present disclosure.
Figure 3:
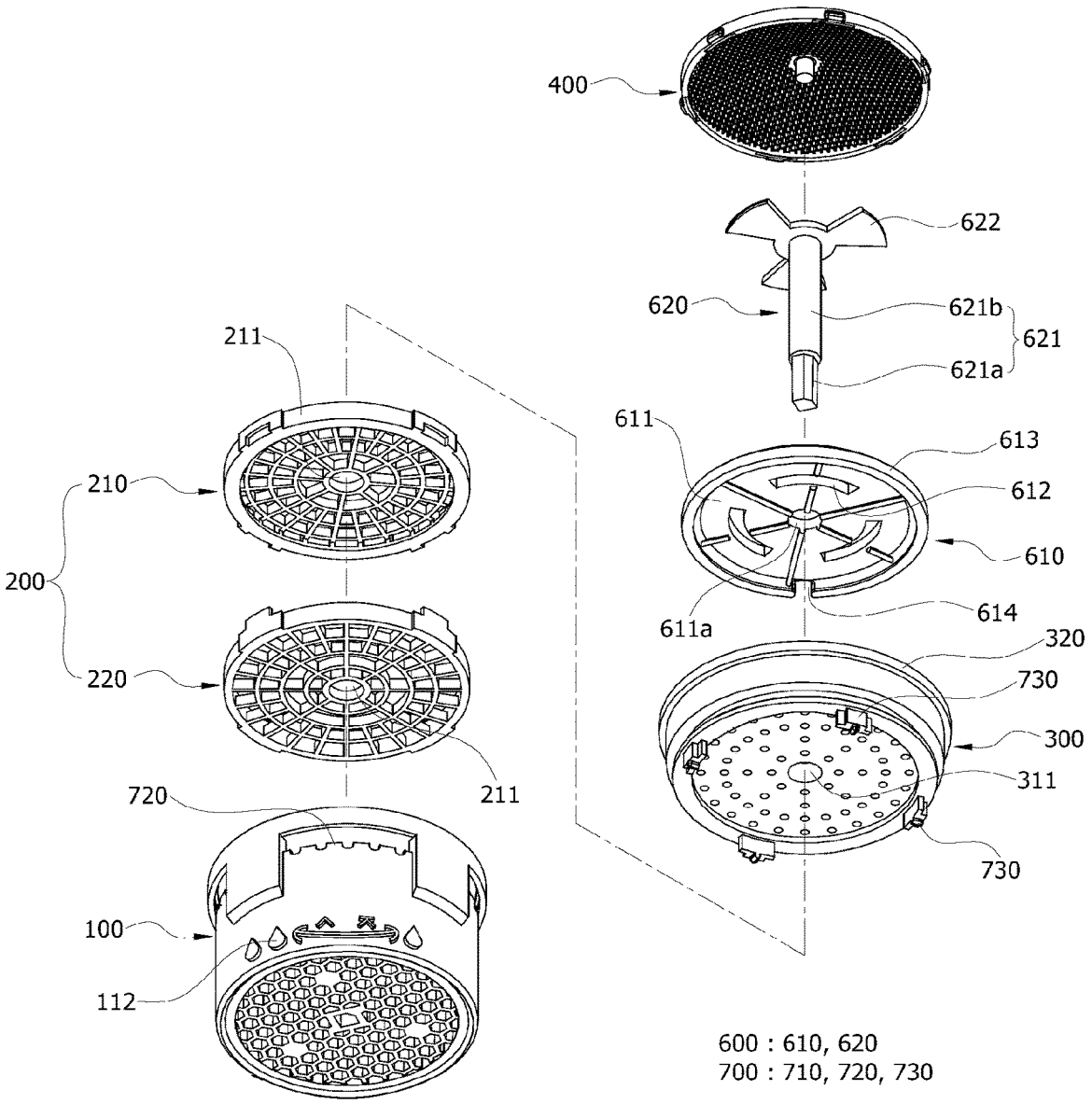
FIG. 3 is an exploded perspective view of the fluid flow control device for a faucet piece according to the present disclosure viewed from an opposite side.
Figure 4:
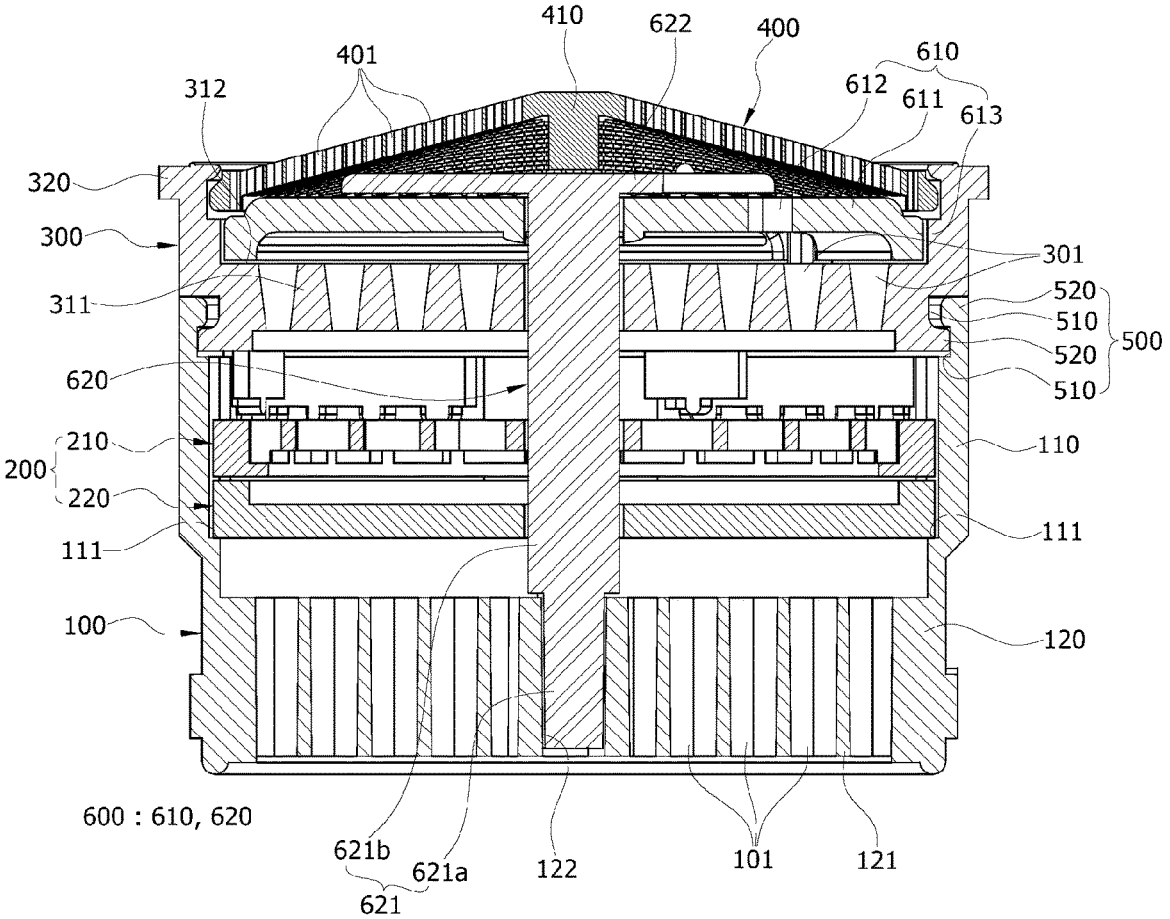
FIG. 4 is a longitudinal sectional configuration view showing the fluid flow control device for a faucet piece according to the present disclosure.
Figure 5:
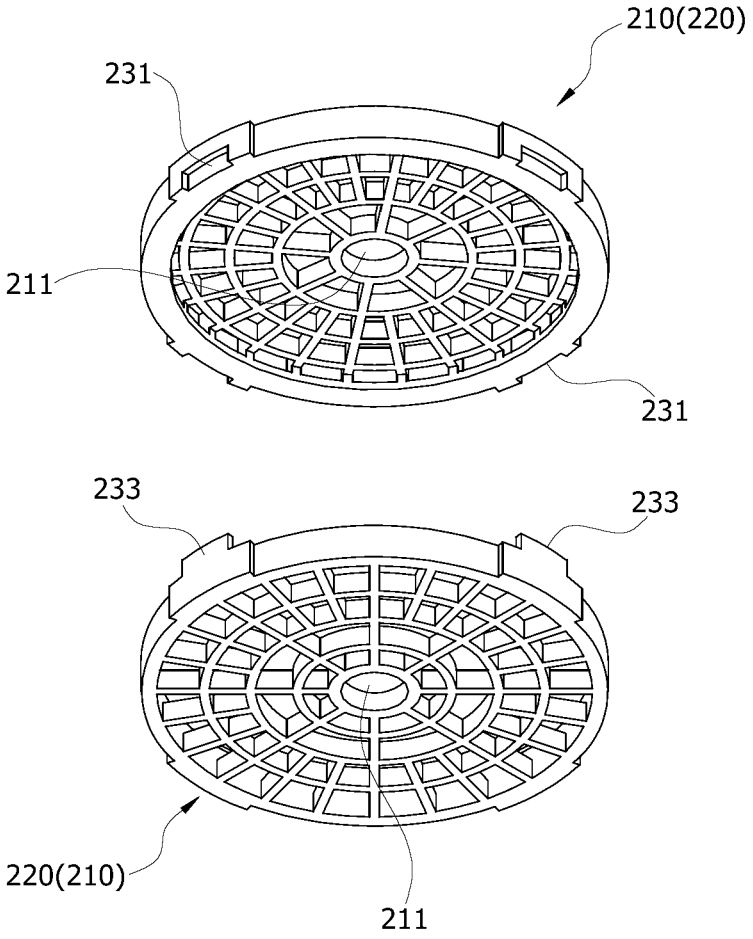
FIG. 5 shows views explaining a coupling configuration between a first water dispersion member and a second water dispersion member constituting a water dispersion means constituting the fluid flow control device for a faucet piece according to the present disclosure.
Figure 6:
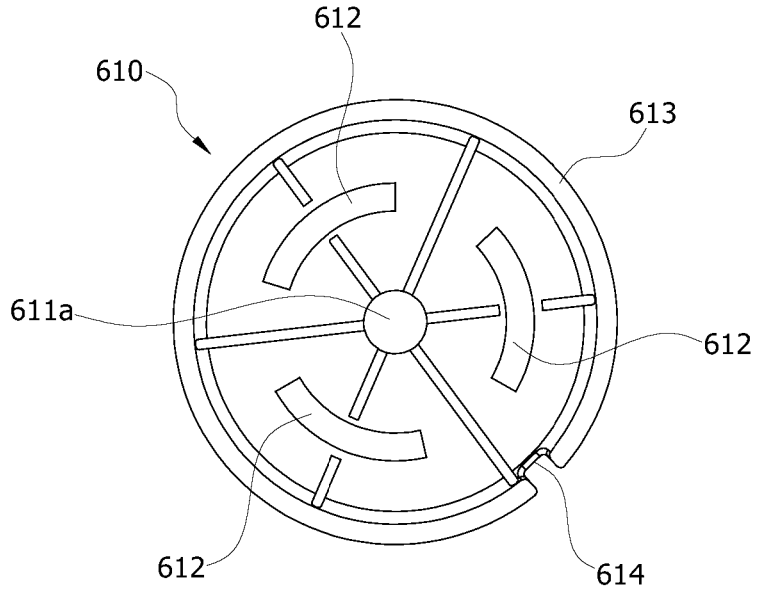
FIG. 6 shows plan views illustrating first and second implementation types of a distribution member constituting a fluid control means included in the fluid flow control device for a faucet piece according to the present disclosure.
Figure 6:
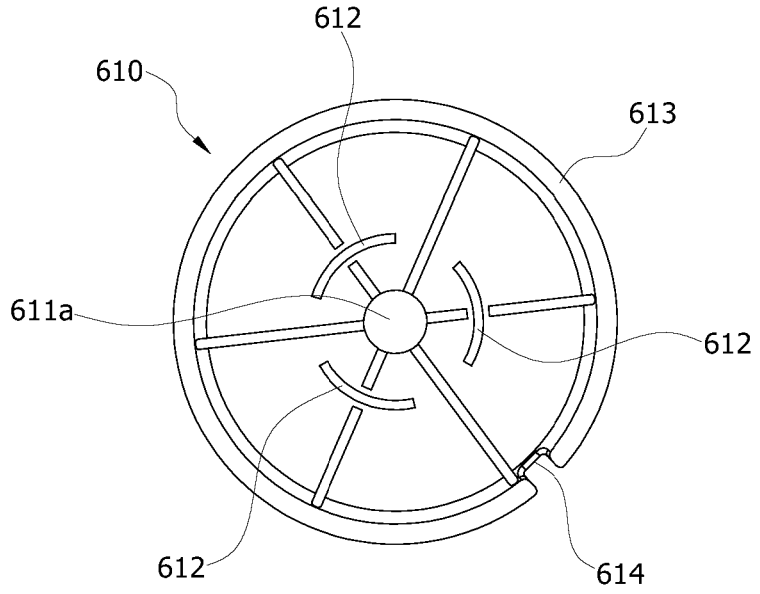

FIG. 1 is one side perspective view showing a fluid flow control device for a faucet piece according to the present disclosure, FIG. 2 is an exploded perspective view viewed from one side of the fluid flow control device for a faucet piece according to the present disclosure, FIG. 3 is an exploded perspective view of the fluid flow control device for a faucet piece according to the present disclosure viewed from an opposite side, FIG. 4 is a longitudinal sectional configuration view showing the fluid flow control device for a faucet piece according to the present disclosure, FIG. 5 shows views explaining a coupling configuration between a first water dispersion member and a second water dispersion member constituting a water dispersion means constituting the fluid flow control device for a faucet piece according to the present disclosure, and FIG. 6 shows plan views illustrating first and second implementation types of a distribution member constituting a fluid control means included in the fluid flow control device for a faucet piece according to the present disclosure.

The fluid flow control device for a faucet piece according to the present disclosure is the fluid flow control device (or an aerator) for a faucet piece for controlling water flow by being provided in a spout of the faucet piece, as largely shown in FIG. 1 to FIG. 6, the device including: a cylindrical type housing 100; a water dispersion means 200 configured to evenly disperse incoming water; a cylindrical type mounting member 300 mounted and fixed to the spout of the faucet piece; a screen mesh member 400; a rotation guide means 500; and a fluid control means 600.

Specifically, the fluid flow control device for a faucet piece according to the present disclosure, as shown in FIG. 1 to FIG. 6, includes: the cylindrical type housing 100 provided with a plurality of water discharge holes 101 at a bottom part and having an opening portion on an upper side and a predetermined diameter; the water dispersion means 200 provided inside the cylindrical type housing 100 and configured to uniformly disperse water flowing in from the spout of the faucet piece; the cylindrical type mounting member 300 having a lower end portion coupled to be able to rotate to an upper end portion of the cylindrical type housing 100, provided with a plurality of water discharge holes 301 at a bottom part, and fixed to the spout of the faucet piece; the screen mesh member 400 provided at an upper end portion of the cylindrical type mounting member 300 and configured to allow water flowing in through the spout of the faucet piece to be passed therethrough, whereby the water is dispersed while being filtered; the rotation guide means 500 provided between the cylindrical type housing 100 and the cylindrical type mounting member 300 and configured to guide relative rotation of the cylindrical type housing 100 and the cylindrical type mounting member 300; and the fluid control means 600 provided in the cylindrical type housing 100 and configured to control the flow rate (or flow velocity, hydraulic pressure, and the like) of water (fluid) flowing into the cylindrical type housing 100 due to relative rotation between the cylindrical type housing 100 and the cylindrical type mounting member 300.

More specifically, the cylindrical type housing 100 is provided in a cylindrical type with an upper portion open and a lower surface closed, as a whole, and includes: a large-diameter portion 110 having a relatively large diameter; and a small-diameter portion 120 provided integrally to one end of the large-diameter portion 110, but having a smaller diameter than the large-diameter portion 110 and provided with the water discharge holes 101 in a bottom part 121.

Here, a step portion 111 is provided at a lower inner periphery of the large-diameter portion 110 protruding along a circumferential direction, and on an upper surface of the step portion 111, an edge of the water dispersion means 200 to be described in detail below is seated and assembled.

The step portion 111 may be provided, entirely or partially with predetermined intervals, over the lower inner periphery of the large-diameter portion 110 in a circumferential direction. At this time, the step portion 111 may be provided to have certain intervals, that is, as in the case of the latter. In this case, the step portion 111 may allow the water to pass between the intervals where the step portion 111 is provided, thereby, by being in conjunction with the water dispersion means 200, performing a part of the function of the water dispersion means 200.

The bottom part 121 of the small-diameter portion 120 is provided to have a predetermined thickness, and the water discharge holes 101 are provided in the bottom part 121.

In the center of the bottom part 121 of the cylindrical type housing 100, the fluid control means 600 to be described later is provided, and a fixing hole or fixing groove 122, in which a lower end part of a fluid control rotation blade member 620 configured to rotate with the rotation of the cylindrical type housing 100 is fixedly mounted, is provided.

In addition, the cylindrical type housing 100 is provided so that a part of the lower end portion (a part of the small-diameter portion 120) is exposed to the outside of the spout of the faucet piece, and the user holds the exposed part and rotates the cylindrical type housing 100 to control discharge flow rate (or flow velocity, hydraulic pressure, water size, and the like) of the water.

Here, a flow rate control display unit 112 is provided on a portion of an outer surface of the lower end portion, which is the exposed part of the cylindrical type housing 100. The flow rate control display unit 112 of the example shown in the drawing shows a case of being provided in an embossed display form.

In addition, a component of a control position stopper means to be described later is provided in the cylindrical type housing 100, and the component will be described in detail below.

Next, the water dispersion means 200 is a component configured to evenly disperse and spread the water flowing into from the spout of the faucet piece through the screen mesh member 400 and may be provided with one or more plate type lattice network members having water passage holes (for example, grill-type water passage holes) of a predetermined pattern.

More specifically, the water dispersion means 200 includes a first lattice network member 210 having water passage holes formed therein as illustrated in the drawing and a second lattice network member 220 having water passage holes having a different size and shape from the water passage holes of the first lattice network member 210.

Such first lattice network member 210 and the second lattice network member 220 have the same diameter and are seated on the upper surface of the step portion 111 provided in the large-diameter portion 110 of the cylindrical type housing 100. In other words, the outer diameters of the first lattice network member 210 and the second lattice network member 220 may be the same as or slightly smaller than the inner diameter of the cylindrical type housing 100.

Here, at centers of the first lattice network member 210 and the second lattice network member 220, shaft through-holes 211 and 221 through which the shaft 621 of the fluid control rotation blade member 620, which constitutes the fluid control means 600 and is configured to rotate with the rotation of the cylindrical type housing 100, passes are provided, respectively.

In addition, when the water dispersion means 200 includes a plurality of lattice network members, for example including the first lattice network member 210 and the second lattice network member 220, as shown in FIG. 5, one or more assembly grooves 231 are provided on an outer periphery of one of the first lattice network member 210 and the second lattice network member 220, and assembly protrusions 232, which the assembly grooves 231 are fitted into and fixed to, are provided on an outer periphery of another one of the first lattice network member 210 and the second lattice network member 220.

In this way, when the water dispersion means 200 includes two or more lattice network members 210 and 220, the assembly between the lattice network members 210 and 220 may be facilitated, and it may be possible to reduce assembly defects between the lattice network members 210 and 220 by assembling the assembled lattice network members.

To continue, the cylindrical type mounting member 300 includes a cylindrical type body part 310 having a predetermined thickness and provided with a plurality of water discharge holes 301 at a bottom part 311 and a fixing flange portion 320 provided to protrude outward in a radial direction on an outer periphery of an upper end portion of the cylindrical type body part 310, whereby the outer periphery is mounted and fixed to the inner periphery of the spout of the faucet piece.

In addition, at an inner periphery of the cylindrical type mounting member 300, a step portion 312 is provided protruding along a circumferential direction, and on an upper surface of the step portion 312, an edge of a flow rate control plate member 610 constituting the fluid control means 600 to be described in detail below is seated and assembled.

The step portion 312 of the cylindrical type mounting member 300 is provided over the entire periphery of the inner circumferential direction, and this is to maintain the function (flow rate control function) of the flow rate control plate member 610 constituting the fluid control means 600.

Here, at a center of the bottom part 311 of the cylindrical type mounting member 300, a shaft through-hole 313 through which the shaft of the fluid control rotation blade member 620, which constitutes the fluid control means 600 to be described later and is configured to rotate with the rotation of the cylindrical type housing 100, passes is provided.

In addition, an assembly protrusion 311*a* (see FIG. 2) is formed on one edge of the bottom part 311 of the cylindrical type body part 310 of the cylindrical type mounting member 300, and an assembly groove or assembly cutout part 614, into which the assembly protrusion 311*a* of the cylindrical type mounting member 300 is fitted, is provided at an edge frame part 613 of the flow rate control plate member 610 constituting the fluid control means 600 to be described later. Therefore, flow rate control plate member 610 may be assembled to be fixed at a position on the cylindrical type mounting member 300 by fitting the assembly protrusion 311*a* into the assembly groove or assembly cutout part 614.

Naturally, the assembly protrusion 311*a* and the assembly groove or assembly cutout part 614 may be provided reversely.

On the other hand, the cylindrical type mounting member 300 may further include a reinforcing fixing means to be able to be mounted in the spout of the faucet piece more robustly and airtightly.

For example, the reinforcing fixing means may be implemented in such a way that a mounting groove is provided in a circumferential direction on the outer periphery of the upper end of the cylindrical type mounting member 300, that is, on the outer periphery of the fixing flange portion 320 of the cylindrical type mounting member 300, and an annular fixing member (or packing member) having a predetermined width and made of a flexible material (for example, a silicone material or a rubber material) may be mounted and fixed to the mounting groove.

Next, the screen mesh member 400 is made of a plate type screen mesh in which a plurality of water passage holes 401 is provided.

Here, the screen mesh member 400 is provided such that a central portion protrudes to one side compared to an edge. In other words, the screen mesh member 400 is provided to be inclined downward from a center to the edge.

Accordingly, a lower surface of the edge of the screen mesh member 400 is seated on an upper surface of an edge of the flow rate control plate member 610, and a central part of the screen mesh member 400 is provided by being spaced apart from the flow rate control plate member 610.

Here, at a center of the lower surface of the screen mesh member 400, a supporting protrusion 410, configured to rotate with the rotation of the cylindrical type housing 100 and to come into contact with a center of an upper surface of the fluid control rotation blade member 620 constituting the fluid control means 600 to support the screen mesh member, is provided.

Next, the rotation guide means 500 may include a guide groove and a guide protrusion, each provided in the circumferential direction at corresponding one of parts facing each other between an upper end part of the cylindrical type housing 100 and a lower end part of the cylindrical type mounting member 300.

Specifically, as exemplified in the drawing, the rotation guide means 500 may include: one or more guide grooves 510 provided in the circumferential direction of any one of the facing surfaces between the upper end part of the cylindrical type housing 100 and the lower end part of the cylindrical type mounting member 300; and one or more guide protrusions 520 provided in the circumferential direction of remaining one of the facing surfaces between the upper end part of the cylindrical type housing 100 and the lower end part of the cylindrical type mounting member 300 and guided along the guide groove 510.

Shown in the drawing is a case in which the guide groove 510 and the guide protrusion 520 both are provided at the upper end part of the cylindrical type housing 100 and the lower end part of the cylindrical type mounting member 300, respectively. In other words, the case in which each of the guide groove 510 and the guide protrusion 520 is provided in the cylindrical type housing 100 and the cylindrical type mounting member 300 is shown, and by providing the guide groove 510 and the guide protrusion 520 simultaneously in both the cylindrical type housing 100 and the cylindrical type mounting member 300 in this way, it is possible to maintain a more stable coupling and rotation for the device.

Next, the fluid control means 600 will be described.

The fluid control means 600 may include: a flow rate control plate member 610 provided to be spaced apart from and interposed between the bottom part 311 of the cylindrical type mounting member 300 and the screen mesh member 400 and having a plurality of flow rate control holes 612; and a fluid control rotation blade member 620 having one side positioned on an upper surface of the flow rate control plate member 610 and an opposite side configured to pass through the shaft through-hole 313 provided in the center of the cylindrical type mounting member 300 and the shaft through-holes 211 and 221 provided in the center of the water dispersion means 200 (that is, the shaft through-holes 211 and 221 provided in the centers of the first and second lattice network members 210 and 220, respectively) and to be fixed not to be possible to rotate to the fixing hole 122 (or the fixing groove 122) provided in the center of the cylindrical type housing 100, thereby rotating together with the rotation of the cylindrical type housing 100 to control the open degree of the flow rate control holes 612 of the flow rate control plate member 610.

The flow rate control plate member 610 includes: a plate type body part 611; one or more flow rate control holes 612 provided by passing through the plate type body part 611; an edge frame part 613 having a predetermined width at an edge of the plate type body part 611 and provided to protrude toward one side (that is, cylindrical type mounting member 300 side); and one or more assembly grooves or assembly cutout parts 614 provided at the edge frame part 613 and configured to be inserted into the assembly protrusions provided in the bottom part 311 of the cylindrical type body part 310 of the cylindrical type mounting member 300.

The flow rate control hole 612 is provided in an arc or a slot in an arc shape having a predetermined length. In addition, a plurality of the flow rate control holes is provided with intervals therebetween at positions on a rotational orbit line that is spaced apart by a predetermined length in the radial direction from a center of the plate type body part 611.

Such a flow rate control hole 612 may be provided as a slot having a relatively small width (width into a radial direction) at a relatively long distance from the center of the plate type body part 611 as shown in FIG. 6A or as a slot having a relatively large width (width into the radial direction) at a relatively close distance compared to FIG. 6A as shown in FIG. 6B, but the present disclosure is not limited thereto.

An opening degree (or opening/closing degree) of such a flow rate control hole 612 is adjusted by the rotation of the fluid control rotation blade member 620 rotating together with the cylindrical type housing 100, whereby the flow rate of water is controlled and passed through.

In addition, to describe the edge frame part 613, the flow rate control plate member 610 may be provided by varying a thickness (thickness into the radial direction) of the edge frame part 613, whereby a cover range of the water discharge holes 301 of the cylindrical type mounting member 300 may be varied. Accordingly, the flow rate, flow velocity, hydraulic pressure, and water stream size may be varied along with the flow control according to the rotation of the fluid control rotation blade member 620 described above.

Here, a shaft through-hole 611*a* through which the shaft 621 of the fluid control rotation blade member 620 passes through is provided in a center of the plate type body part 611.

To continue, the fluid control rotation blade member 620 includes a shaft 621 having a predetermined length and a plurality of blades 622 integrally provided at one end part (upper end part in the drawing) of the shaft 621.

The shaft 621 is provided to be stepped in two step portions, and a lower step portion is inserted into and fixed to the shaft through-hole 313 of the cylindrical type housing 100.

In other words, the shaft 621 may include a fixed portion 621*a* having a lower end inserted into and fixed to the shaft through-hole 313 of the cylindrical type housing 100 and a shaft portion 621*b* provided by having a diameter larger than a diameter of the fixed portion 621*a* (in other words, diameter larger than a diameter of the shaft through-hole 313 of the cylindrical type housing 100).

The fixing portion 621*a* of the shaft 621 is configured to pass through the shaft through-hole 313 provided in the center of the cylindrical type mounting member 300 and the shaft through-holes 211 and 221 provided in the center of the water dispersion means 200 and to be fixed not to be able to rotate to the fixing hole 122 (or the fixing groove 122) provided in the center of the cylindrical type housing 100.

In addition, the blades 622 are provided in a plurality of plate type blades in a fan shape extending outward from one end part of the shaft 621 and are provided to correspond to the number of the flow rate control holes 612.

The blades 622 are configured to rotate together with the rotation of the cylindrical type housing 100 to control the open degree of the flow rate control holes 612 of the flow rate control plate member 610.

In other words, the blade 622 is provided to have a width that may cover the flow rate control hole 612 corresponding thereto in the rotational direction when the flow rate control hole 612 is closed.

As such, the blade 622 is configured to control the opening/closing and the opening/closing degree of the flow rate control hole 612 during rotation.

On the other hand, the fluid flow control device for a faucet piece according to the present disclosure further includes a control position stopper means 700 configured to maintain a position of the cylindrical type housing 100 rotated with respect to the cylindrical type mounting member 300.

The control position stopper means 700 may include: a cutout part or slot 710 provided in a predetermined length in the circumferential direction of the cylindrical type housing 100; a prominence and depression portion 720 provided at a lower end of the cutout part or slot 710; and a stopper protrusion 730 provided at a position, corresponding to a position of the cutout part or slot 710, on one side of a lower edge of the cylindrical type mounting member 300 and separated from or settled in a depression portion of the prominence and depression portion 720 due to the rotation of the cylindrical type housing 100.

The cutout part or slot 710 and the stopper protrusion 730 may be provided in the number of at least one, respectively. In addition, the control positions between the cutout part or slot 710 and the stopper protrusion 730 are provided by being in associated with the opening/closing degree of the flow rate control hole 612 by the blade 622 of the fluid control rotation blade member 620 that rotates together with the rotation of the cylindrical type housing 100.

According to the fluid flow control device for a faucet piece according to the present disclosure, as described above, the device may be easily used by anyone to control the flow rate, flow velocity, hydraulic pressure, water stream size, and the like besides a basic function of gently discharging discharged water, each component constituting the device is easy to manufacture to promote productivity improvement and manufacturing cost reduction, and each component constituting the device may be easily completely assembled.

The present disclosure has the effect in that the device may be easily and robustly installed in the spout of the faucet piece, may easily recognize a sense of stepwise control of flow velocity and hydraulic pressure, and may stably maintain a control position to improve usability.

Although the above-described embodiments have been described with reference to the limited drawings, those skilled in the art may apply various technical modifications and variations on the basis of the above. For example, even when the described techniques are performed in an order different from the described method, and/or the described components of the system, structure, device, circuit, and the like are coupled to or combined with each other in a form different from the described method or replaced by or substituted with other components or equivalents, an appropriate result may be achieved.

The embodiments described in the present specification and the accompanying drawings are merely illustrative of some of the technical ideas included in the present disclosure. Therefore, since the embodiments disclosed in the present specification are for explanation rather than a limitation of the technical spirit of the present disclosure, it is obvious that the scope of the technical spirit of the present disclosure is not limited by these embodiments. As a result, modifications and specific embodiments that may be easily inferred by those skilled in the art within the scope of the technical spirit included in the specification and drawings of the present disclosure should be interpreted as being included in the scope of the present disclosure.

INDUSTRIAL APPLICABILITY

The present disclosure may be applied to a faucet piece.

What is claimed is:

1. A fluid flow control device for a faucet piece, the device comprising:

a cylindrical type housing provided with a plurality of water discharge holes at a bottom part and having an opening portion on an upper side;

a water dispersion means provided inside the housing and configured to uniformly disperse water flowing in;

a cylindrical type mounting member having a lower end portion coupled to be able to rotate to an upper end portion of the housing, provided with a plurality of water discharge holes at a bottom part, and fixed to a spout of the faucet piece;

a screen mesh member provided at an upper end portion of the mounting member;

a rotation guide means provided between the housing and the mounting member and configured to guide relative rotation of the housing and the mounting member; and a fluid control means configured to control flow rate of water flowing into the housing due to relative rotation between the housing and the mounting member, wherein the fluid control means comprises:

a flow rate control plate member provided to be spaced apart from and interposed between the bottom part of the mounting member and the screen mesh member and having a plurality of flow rate control holes; and a fluid control rotation blade member having one side positioned on an upper surface of the flow rate control plate member and configured to rotate together with the rotation of the cylindrical type housing for adjusting the opening degree of the flow rate control holes.

2. The device of claim 1, wherein the fluid control means comprises:

a fluid control rotation blade member having an opposite side configured to pass through the mounting member and the water dispersion means and to be fixed to a fixing hole provided in a center of the housing.

3. The device of claim 2, wherein the flow rate control plate member comprises:

a plate type body part;

one or more flow rate control holes provided by penetrating through the plate type body part;

an edge frame part provided to protrude toward a mounting member side; and one or more assembly protrusions or assembly grooves provided at the edge frame part and configured to be inserted into the assembly protrusions or assembly grooves provided in a bottom part of the mounting member, and the fluid control rotation blade member comprises:

a shaft having a predetermined length; and a plurality of blades provided at one end part of the shaft and positioned on upper surfaces of the flow rate control holes, respectively.

4. The device of claim 3, wherein the flow rate control holes are provided in a plurality of slots, each in an arc shape, with intervals therebetween at positions on a rotational orbit line that is spaced apart by a predetermined length in a radial direction from a center of the plate type body part, and the blades are provided in a plurality of plate type blades in a fan shape extending outward from one end part of the shaft.

5. The device of claim 2, wherein the water dispersion means is provided with one or more plate type lattice network members each having a plurality of water passage holes and a shaft through-hole at a center, the screen mesh member is made of a plate-shaped screen mesh having a plurality of water passage holes, the mounting member comprises:

a cylindrical type body part provided with a plurality of water discharge holes at the bottom part and a shaft through-hole at a center; and a fixing flange portion provided to protrude outward in a radial direction on an outer periphery of an upper end of the body part, the housing comprises:

a large-diameter portion having a predetermined diameter; and a small-diameter portion having a smaller diameter than the large-diameter portion and provided with the water discharge holes in a bottom part, at a lower inner periphery of the large-diameter portion, a step portion is provided to protrude along a circumferential direction, and in a center of the bottom part of the small-diameter portion, a fixing hole or fixing groove, in which a lower end part of the fluid control rotation blade member constituting the fluid control means is fixedly mounted, is provided.

6. The device of claim 2, wherein the water dispersion means comprises:

a first lattice network member having water passage holes; and a second lattice network member having water passage holes having a size and shape different from the water passage holes of the first lattice network member, wherein, on an outer periphery of one of the first lattice network member and the second lattice network member, at least one of the assembly grooves and/or assembly protrusions is provided, and on an outer periphery of another one of the first lattice network member and the second lattice network member, at least one of the assembly grooves and/or assembly protrusions is provided.

7. The device of claim 2, wherein, at one edge of the bottom part of the mounting member, an assembly protrusion or an assembly groove is provided, and at an edge frame part of the flow rate control plate member, an assembly groove or an assembly protrusion, which is assembled with the assembly protrusion or the assembly groove of the mounting member, is provided.

8. The device of claim 2, wherein the screen mesh member is provided to be inclined downward from a center to the edge, and at a center of a lower surface of the screen mesh member, a supporting protrusion, configured to come into contact with a center of an upper surface of the fluid control rotation blade member to support the screen mesh member, is provided.

9. The device of claim 1, wherein the rotation guide means comprises a guide groove and a guide protrusion, each provided in a circumferential direction at corresponding one of parts facing each other between an upper end part of the housing and a lower end part of the mounting member, and the device further comprises:

a mounting groove provided in a circumferential direction on an outer periphery of an upper end of the mounting member; and an annular fixing member having a predetermined width and made of a flexible material, thereby being mounted and fixed to the mounting groove.

10. The device of claim 1, further comprising a control position stopper means configured to maintain a position of the housing rotated with respect to the mounting member.

11. The device of claim 10, wherein the control position stopper means comprises:

a slot provided in a predetermined length in a circumferential direction of the housing;

a prominence and depression portion provided at a lower end of the slot; and a stopper protrusion provided at a position, corresponding to a position of the slot, on one side of a lower edge of the mounting member and separated from or settled in a depression portion of the prominence and depression portion due to the rotation of the housing.

* * * * *